US005617599A

United States Patent [19]

Smith

[11] Patent Number: 5,617,599

[45] Date of Patent: Apr. 8, 1997

[54] BRIDGE DECK PANEL INSTALLATION SYSTEM AND METHOD

[75] Inventor: Peter Smith, Gansevoort, N.Y.

[73] Assignee: Fomico International, Schuylerville, N.Y.

[21] Appl. No.: 444,390

[22] Filed: May 19, 1995

[51] Int. Cl.[6] ..... E01D 21/00

[52] U.S. Cl. ..... 14/73; 14/77.1

[58] Field of Search ..... 14/73, 74.5, 77.1, 14/73.1, 73.5; 52/223.6, 223.7, 250, 251, 259, 297, 299, 698, 699, 700, 701, 705, 707; 404/34, 43

[56] References Cited

U.S. PATENT DOCUMENTS

| | | | |
|---|---|---|---|
| 3,253,289 | 5/1966 | Nagin | 14/73 |
| 3,621,626 | 5/1970 | Tylius . | |
| 4,140,414 | 2/1979 | Buttgereit . | |
| 4,307,974 | 12/1981 | George | 14/73.1 X |
| 4,430,019 | 2/1984 | D'Alessio . | |
| 4,493,177 | 1/1985 | Grossman . | |
| 4,646,493 | 3/1987 | Grossman . | |
| 4,710,994 | 12/1987 | Kishida et al. . | |
| 4,846,615 | 7/1989 | Forsyth . | |
| 4,865,486 | 9/1989 | Bettigole . | |
| 4,972,537 | 11/1990 | Slaw, Sr. . | |
| 4,977,636 | 12/1990 | King | 14/73 |
| 4,991,248 | 2/1991 | Allen . | |
| 5,025,522 | 6/1991 | Eskew et al. . | |
| 5,311,629 | 5/1994 | Smith . | |
| 5,457,840 | 10/1995 | Derechin | 14/73 |

FOREIGN PATENT DOCUMENTS

| | | | |
|---|---|---|---|
| 2698111 | 5/1994 | France | 14/73 |
| 087407 | 4/1991 | Japan | 14/73 |

*Primary Examiner*—James A. Lisehora
*Attorney, Agent, or Firm*—Schmeiser, Olsen & Watts

[57] ABSTRACT

This invention involves a system and method for the installation of a prefabricated composite structural members. The system utilizes deck panels which have a plurality of steel C-beam pairs attached to the underside such that a series of channels is formed. Bored through each deck panel is a plurality of access holes which projects through the panel and into one of said channels. Thus, installers can access underlying bridge girders from the surface of the deck panels thereby allowing for top-side installation. The system also provides a top-side vertically adjusting device for raising or lowering the deck panels to allow for the top-side installation of shimming devices.

11 Claims, 3 Drawing Sheets

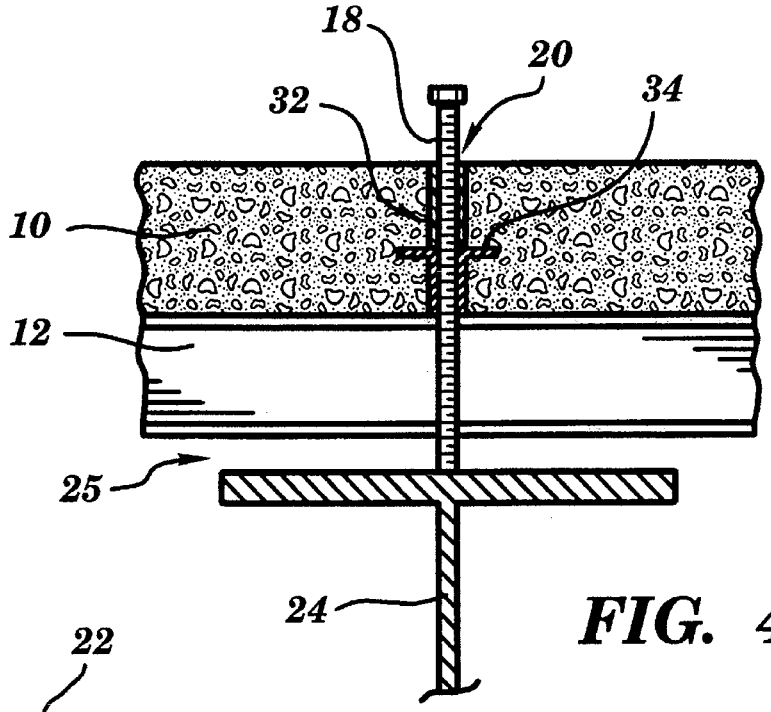
FIG. 4
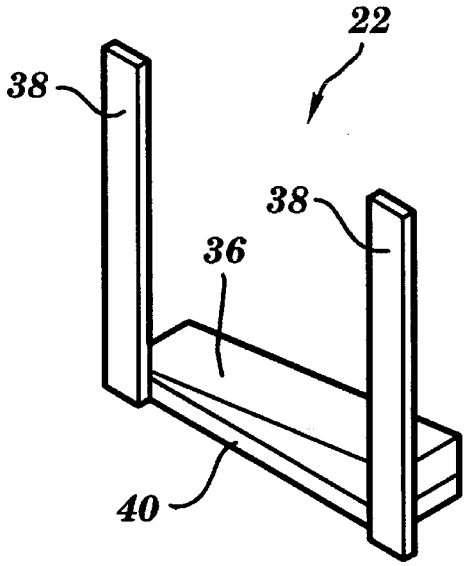
FIG. 5
FIG. 6
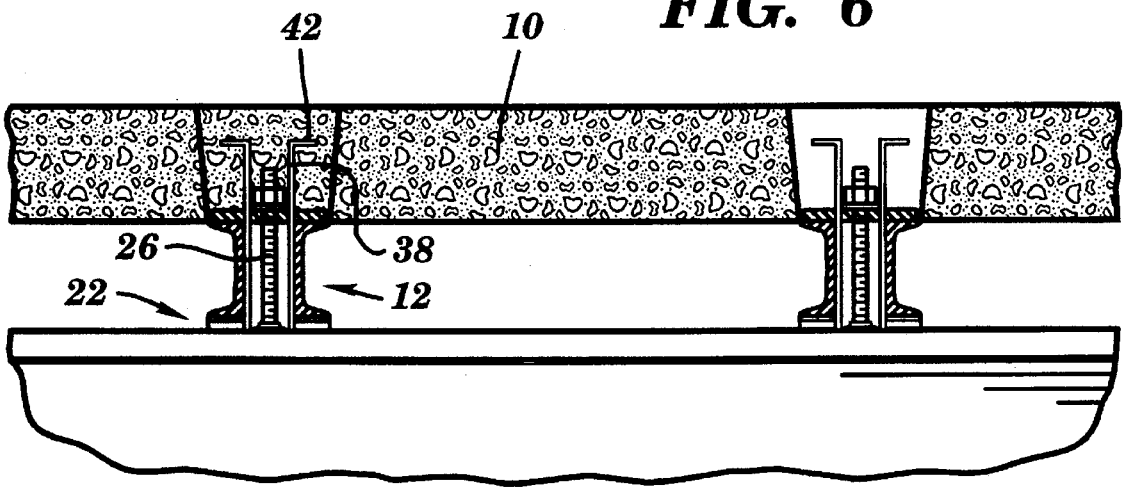

BRIDGE DECK PANEL INSTALLATION SYSTEM AND METHOD

BACKGROUND OF THE INVENTION

1. Technical Field

The present invention generally relates to a system and method for installing composite, structural members. More particularly, the present invention relates to the installation of precast concrete bridge deck panels onto a bridge girder system by incorporating a system of access holes, C-beams, and an adjusting apparatus.

2. Background Art

Precast concrete deck panels are currently considered the state of the art for forming bridge decks between girders and bridge construction. The use of such deck panels has proven to be both economical and convenient. The present installation techniques of such systems, present the disadvantage that workers need to work beneath the deck panels in order to install the systems. Thus, additional costs and inconveniences are added to the install procedure. These inconveniences can include scaffolding which may need to be assembled under the bridge.

Another disadvantage of presently designed precast concrete deck panels is that they are vertically supported in their correct position by a grout material (cementations or otherwise). Not only is the grout costly to buy but costly forms must typically be provided to install it.

A final major disadvantage of grout-supported systems exist. The grout must harden to a specified strength before traffic loads may be placed upon the panel. This is particularly troublesome when it is necessary to place this type of deck overnight, where traffic volumes are so large that the deck simply cannot be out of service during the day.

The typical installation of present-day precast panels may include hold down bolts that tie down the deck panel to the bridge girders. Since these systems typically fasten through the top flange of the girders (or stringers), difficult labor intensive tasks below the bridge deck surface are created. A similar problem arises when attempting to install grout between the precast deck panel and the supporting girders (or stringers). In these situations the deck panels need to be supported in their correct vertical position while supporting grout is placed. Again, a difficult and labor intensive task is required which involves workers below the deck surface.

Thus, a need exists for an installation system for precast concrete deck panels which would allow for complete installation from the top side of the deck panels including the installation and adjustment of shimming devices and for a system which is ready for immediate usage upon installation, without waiting for grout to harden. Providing such an installation system would eliminate the time consuming assembly and removal of grout forms and an underneath scaffolding system.

SUMMARY OF THE INVENTION

The present invention satisfies the need for a system and method of top side installation of bridge deck panels onto bridge girders. The present invention provides, in a first aspect, precast deck panels with opposed pairs of steel C-beams or other support members such as I-beams or the like attached on the bottom thereto. In between each C-beam pair is an open channel. In addition, each deck panel contains access holes which run through the deck panel such that each hole begins on the surface of the deck panel and terminates on the bottom of the deck panel in between the C-beam pairs in the aforementioned channel.

The present invention provides, in a second aspect, deck panels containing a plurality of threaded inserts which allow for a temporary adjusting bolt to be screwed through and into an underlying bridge girder, thereby allowing the deck to be raised so that shims can be placed thereunder.

Another aspect of the invention is providing a plurality of shims that may be installed from the top of the deck. The shims may be of varying height to compensate for various tolerances between the girder and C-beams. The shims may also advantageously act as anchor bolts.

Yet another advantage of the present invention is to provide a precast concrete deck that may be quickly and efficiently installed allowing travel thereover before the final concrete is poured to anchor the shims. Since the deck of the present invention is installed as panels, long term maintenance is relatively easy. The panels need simply to be replaced with a new panel using similar installation techniques.

Another advantage is that true composite action may be obtained between deck and supporting stringer.

BRIEF DESCRIPTION OF THE DRAWINGS

These and other advantages of the present invention will become more readily apparent upon reading the following detailed description and upon reference to the drawings to which:

FIG. 4 depicts a cross sectional view of an adjusting bolt pursuant to the present invention;

FIG. 5 depicts a shimming device as described in the present invention; and

FIG. 6 depicts a cross sectional view showing the final installation of the system pursuant to this invention.

DETAILED DESCRIPTION OF THE PREFERRED EMBODIMENTS

Figure 1:
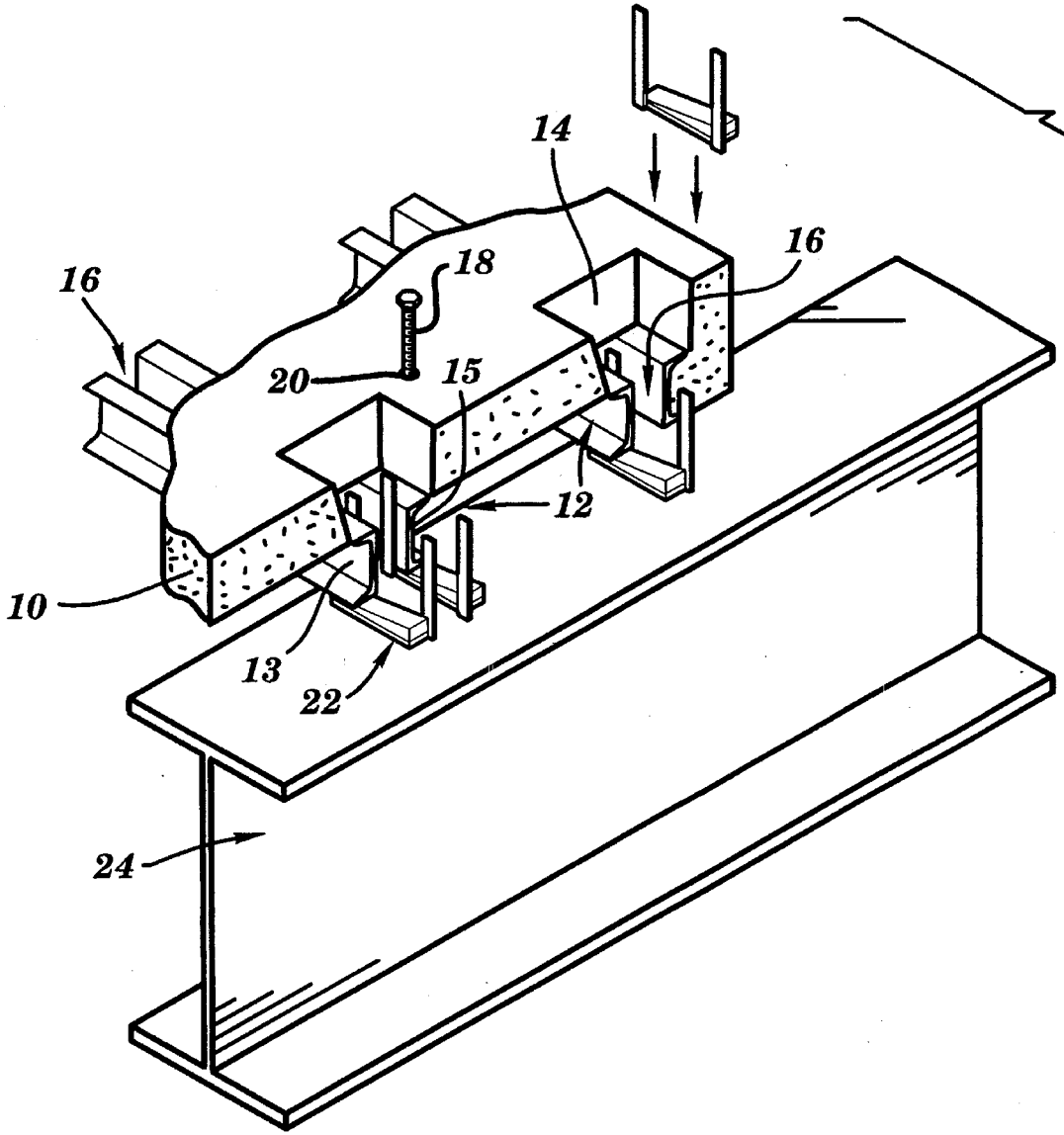
FIG. 1 depicts an isometric section showing the essential aspects of the preferred embodiment pursuant to the present invention.

Referring now to the drawings, and more particularly to FIG. 1, there is shown some of the parts which make up the decking installation system pursuant to this invention. The decking system of the present invention includes concrete deck panels 10, each having a plurality of steel C-beam pairs 12 mounted thereto by means of commonly used stud or other well known shear connectors (not shown) (this combination hereinafter referred to as the "channel deck"). It is envisioned that the deck panels and underlying steel C-beams (i.e. the channel decks) may be pre-formed as a single pre-stressed structural member in a manner known or used in the art.

Each C-beam pair 12 is comprised of a left C-beam 13 and right C-beam 15. The C-beams are spaced apart such that a channel 16 is formed between the left and right C-beams beneath decking panel 10. During installation, C-beam pairs 12 rest upon, and are mounted to, a system of existing bridge girders 24 or stringers. During the installation of a bridge decking system, shims typically need to be installed between the existing bridge girder and the underlying steel support beams to overcome imperfections in the girders or to create any necessary inclines or cross slopes in the roadway. Pursuant to this invention, shims 22 are utilized in a manner described below.

Deck panels 10 also comprise a plurality of access holes 14. Access holes 14 provide the installers of the channel deck a means of accessing the underlying bridge girder from the surface of the deck panel. This means may include a nut and hold-down plate which would fasten down onto one or more bolts welded to the underlying girder (See FIG. 2). Other means of attachment involving clamping or fastening devices known in the art, while not specifically disclosed, may also be utilized.

The access holes 14 also permit shims 22 to be placed into position below the deck panel by workers on the surface of the deck panel. This is made possible through the use of a adjusting bolt 18. Adjusting bolt 18 is a temporary device which can be inserted into and through hole 20. As the bolt is screwed through the decking surface, it will eventually come out of the bottom and press against existing girder 24. As the bolt is further engaged it will raise up decking panel 10 thereby allowing shims 22 to be easily placed in between C-beam pairs 12 and bridge girder 24 via access hole 14.

Figure 2:
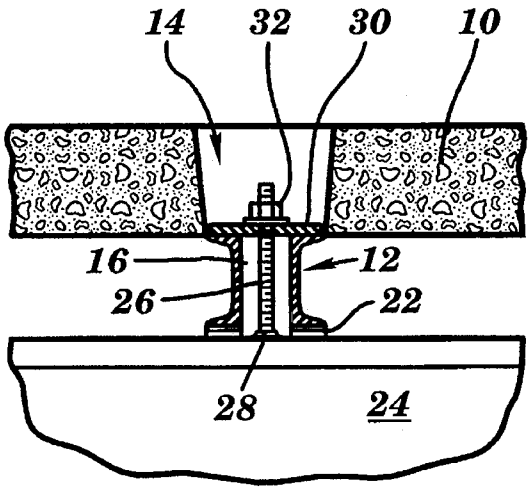
FIG. 2 shows a cross sectional view of the installation system pursuant to the present invention.

Referring now to FIG. 2, a cross sectional view is shown depicting a preferred means of mounting the channel deck to the underlying girder pursuant to this invention. Steel C-beam pair 12, which was pre-formed with concrete deck panel 10, is shown laying on girder 24. Pursuant to this embodiment, a plurality of bolts 26 are welded 28 to girder 24 at predetermined positions after the laying of the channel deck. The bolts 26 are welded such that they extend up through channel 16 (formed by C-beam pair 12) and into access hole 14. A welding gun having an elongate end is used to securely fasten the bolts in place.

To secure the decking to the underlying girders, hold-down plate 30 is placed over the bolt 26 such that it meets, and covers, the top surface of C-beam pair 12. Nut and washer 32 is then fastened down onto hold-down plate 30. It should be appreciated from this that this system allows for the complete securement of the structural member onto the girder system from the top surface of the deck panels. Without the use of grout which is expensive, costly to install and must sufficiently harden before the deck can be used.

Figure 3:
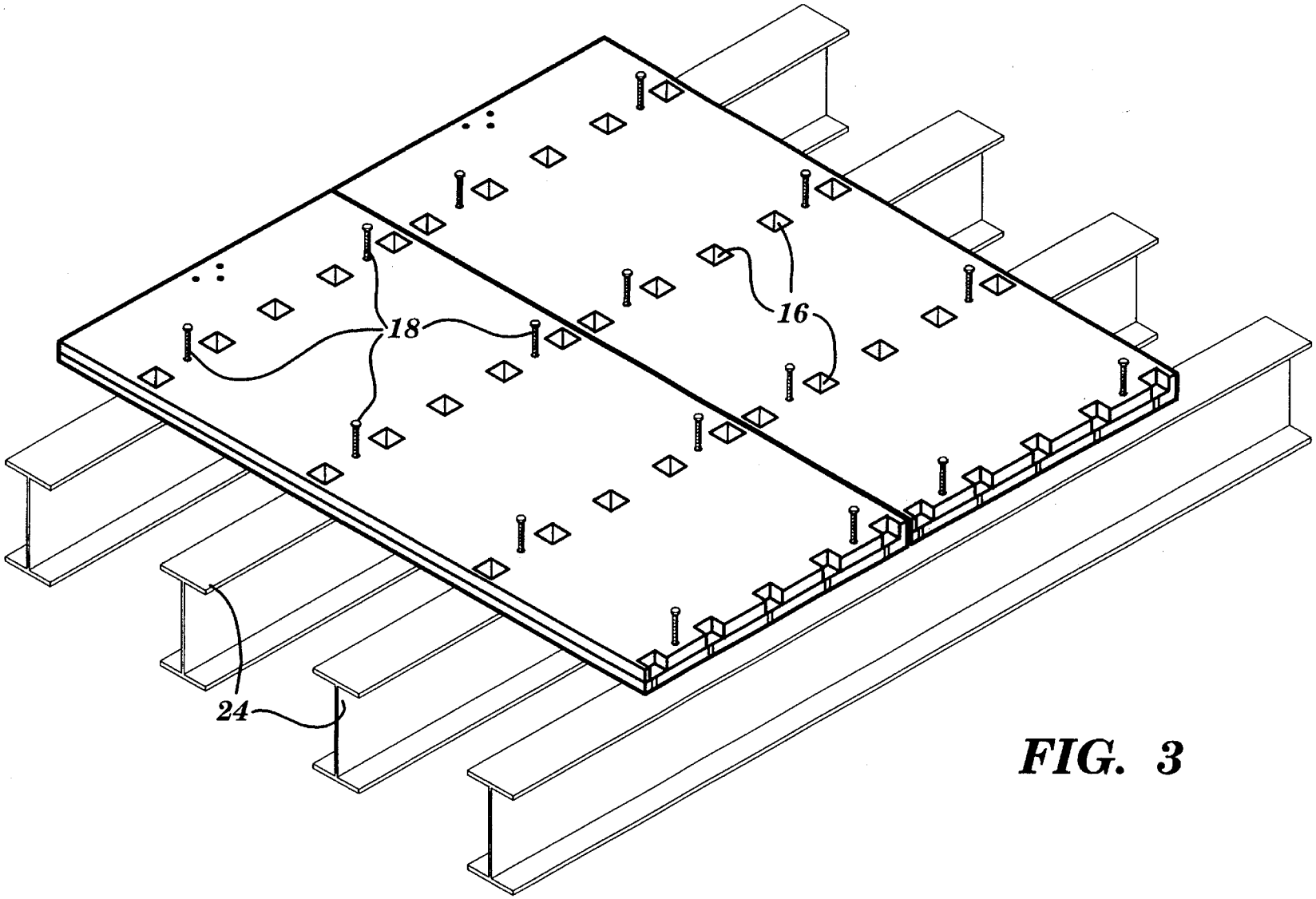
FIG. 3 depicts an isometric view of the deck panels pursuant to the present invention.

Referring now to FIG. 3, the top surface of a pair of typical deck panels are shown resting on top of a system of girders 24. As is evident from the drawing, access holes 16 and adjusting bolts 18 are specifically located to line up with the underlying girders 24. As noted above, adjusting bolts 18 can be utilized to lift the decking thereby allowing shims to be placed between the C-beam pairs (not shown) and the underlying girder 24 via access holes 16. Again, this process can be done entirely from the surface of the deck panel.

Referring now to FIG. 4, a cross sectional view of a adjusting bolt 18 is shown. Adjusting bolt 18 is inserted into a hole 20 in deck panel 10 which may be partially lined with a PVC sleeve 32. The bolt 18 is threaded through threaded insert 24 and projects out of the bottom of the deck panel. The height between each C-beams and girder 24 is measured and an appropriate shim 22 is selected to match the height. The shims 22 are premanufactured to be of varying height such that an appropriate height shim may be selected to match the height between each C-beam and girder. After a height has been determined and a shim selected, the bolt is further driven to engage girder 24 and lift the deck panel further off of the girder 24. Screwing of bolt 18 into girder 24 creates a greater gap between the C-beam pair 12 and the girder 24. By utilizing a nearby access hole shims can be strategically placed from above the deck panel. After the shims have been inserted, the adjusting bolt 18 can be removed, thereby lowering the channel deck back onto the underlying girder 24.

Referring now to FIG. 5, one of many possible embodiments of a shim 22 which could be used pursuant to this invention is shown. The shim 22 may typically comprise a base 40, an inclined plane 36, and one or more vertical tabs 38. As is shown in FIG. 6, each shim 22 is designed to be placed down into an access hole, in between a C-beam pair 12, and underneath one of the C-beams. Vertical tabs 38 allow for easy maneuverability of the shim 22 for placement thereof. Vertical tab 38 may also comprise a bent portion 42 which will 1) further improve maneuverability of the shim during installation and 2) increase the overall structural efficacy of the system. Note that hold-down plate 30 (see FIG. 2) may need to be specifically designed to not interfere with the placement of the vertical tabs 38.

Upon completion of the installation procedure outlined above, the only remaining step is to fill the access holes. Typically, as is shown in the left access hole of FIG. 6, a concrete mixture or other known paving material can be used to fill the hole. A bend 42 in the vertical tabs 38 of the shims 22 provides an anchor bolt action after the access hole has been filled. When it is necessary to more fully develop composite action between the deck panel 10 and the underlying girder 24, the channel 16 below the access hole 14 is also filled with the same concrete mixture.

Although the preferred embodiment of this invention is specifically directed to bridge decking systems, it is envisioned that this system could be adapted in any situation where the installation of structural members is required.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

I claim:

1. A prefabricated composite structural member comprising:

a deck panel having a topside and an underside;

at least one pair of support members mounted in parallel to the underside of said deck panel;

at least one channel on said underside of said deck panel formed between said at least one pair of support members wherein said channel has a predetermined width;

at least one access hole projecting from the topside to the underside of said deck panel wherein said at least one access hole has a width greater than said predetermined width of said channel; and shimming devices wherein said devices are positionable beneath at least one pair of support members, and above an existing girder through said access hole.

2. The structural member of claim 1 further comprising fill material for filling said access hole.

3. The structural member of claim 1 further comprising a plurality of adjusting holes in said deck panel and a plurality of adjusting bolts insertable through said adjusting holes.

4. A bridge decking system comprising:

a composite structural member comprising a deck panel and a lower support member, said lower support member including a plurality of opposed beam pairs;

a plurality of channels wherein each channel is formed between one of said opposed beam pairs and wherein each of said channels has a predetermined width;

a plurality of access holes through said deck panel wherein each of said access holes has a width greater than said predetermined width of said channels and terminates in one of said channels; and shimming devices wherein said devices are positionable beneath said plurality of opposed beam pairs, and above an existing girder through one of said access holes.

5. The decking system of claim 4 further comprising a fastening apparatus for fastening said structural member to an existing girder having a bolt vertically mounted thereon, said fastening apparatus being accessible from a top side of said deck panel via one of said access holes.

6. The fastening apparatus of claim 5 comprising a hold-down plate, at least one washer and at least one nut, said hold-down plate, washer and nut mountable to said bolt when said bolt is projecting through one of said channels and into one of said access holes.

7. The shimming devices of claim 4 wherein said shimming devices includes at least one vertical member attached thereto.

8. The decking system of claim 4 further comprising an adjusting apparatus, said adjusting apparatus being accessible from a topside of said deck panel and capable of raising said decking panel off of an existing girder so that a shimming device can be placed beneath one of said plurality of opposed beam pairs.

9. The decking system of claim 8 wherein said adjusting apparatus comprising:

a plurality of adjusting holes projecting through said deck panel, said adjusting holes being fitted with a threaded insert; and an adjusting bolt suitable for rotatable insertion through said adjusting holes from the topside of said deck panel and engagement of an underlying girder, thereby providing a means for raising said decking panel upon impact of said adjusting bolt on said existing girder.

10. A method for installing precast deck panels on a bridge support comprising the steps of:

precasting deck panels with a plurality of beam pairs mounted on the bottom thereof;

providing access holes in said deck panels above each of said plurality of beam pairs;

placing a deck panel on an existing steel girder frame; and placing a shim between at least one of said beams and said existing steel girder frame through at least one of said access holes.

11. The method of claim 10, further comprising the step of:

filling said access hole with paving material.

* * * * *